US005385345A

United States Patent [19]

Azure

[11] Patent Number: 5,385,345

[45] Date of Patent: Jan. 31, 1995

[54] MULTIFACETED RACQUET

[76] Inventor: Joseph Azure, 21 Tilden St., Staten Island, N.Y. 10301

[21] Appl. No.: 142,126

[22] Filed: Oct. 28, 1993

[51] Int. Cl.[6] ..... A63B 59/00

[52] U.S. Cl. ..... 273/67 B; 273/67 R

[58] Field of Search ..... 273/67 R, 67 B, 73 R, 273/73 C

[56] References Cited

U.S. PATENT DOCUMENTS

| | | | |
|---|---|---|---|
| 1,930,281 | 10/1933 | Ogden | 273/67 B |
| 3,416,798 | 12/1968 | Pennington . | |
| 3,990,699 | 11/1976 | Urmston | 273/67 B |
| 4,368,890 | 1/1985 | Horstman . | |
| 4,512,583 | 4/1985 | Leveque de Vilmorin . | |
| 5,074,554 | 12/1991 | Ramon, Jr. | 273/67 R |
| 5,236,191 | 8/1993 | Capriati | 273/67 B |

FOREIGN PATENT DOCUMENTS

| | | | |
|---|---|---|---|
| 909812 | 9/1972 | Canada . | |
| 0427522 | 5/1991 | European Pat. Off. . | |
| 2643274 | 8/1990 | France | 273/67 B |
| 197803 | 3/1978 | Germany | 273/67 B |

*Primary Examiner*—Mark S. Graham

*Attorney, Agent, or Firm*—Richard C. Litman

[57] ABSTRACT

A multifaceted racquet for use in volleying type games such as racquetball, handball and the like, includes plural, spaced apart surfaces with a handle extending between the surfaces. The surfaces are preferably strung in a manner similar to a tennis racquet or the like, to provide greater resiliency. The plural surfaces may form a polyhedron, with the polyhedron having one side open for access to the handle within. Preferably, each of the surfaces is of the same size and shape and spaced equidistantly from the central handle, in order to reduce the number of variables involved in use. Each of the peripheries of the surfaces is preferably substantially circular in form, although other shapes may be provided as desired. The handle preferably passes through the geometric center of the device, in order to reduce or eliminate non-symmetrical forces when a projectile is struck squarely. The frame of the apparatus may be formed of any of a number of materials, from wood and metal to synthetics and plastics and synthetic fiber materials. The multifaceted racquet provides a striking surface at least approximately aligned for virtually any projectile trajectory, thus reducing the risk of undue arm or wrist twisting which may occur using a conventional racquet, and allowing faster reaction times, particularly for difficult shots.

18 Claims, 2 Drawing Sheets 10
18
30
34
48
42
20
32
34
36
38
42
26
36
34
46
44
40
14
36
42
34
48
34
24
12
22
16
28

MULTIFACETED RACQUET

FIELD OF THE INVENTION

The present invention relates generally to racquets, paddles and the like used in volleying type games (e. g., tennis, racquetball and handball), and more specifically to a racquet having a plurality of surfaces in a three dimensional array with a central handle and providing for the striking of the ball or projectile using any one of the multiple racquet surfaces.

BACKGROUND OF THE INVENTION

The typical racquet used in the sport of racquetball is essentially a smaller and shorter handled version of a tennis racquet, and thus provides a single strung panel having opposite first and second surfaces for forehand and backhand use. While a skilled player may be able to return most shots using only the two sides of the single racquet panel, it can be difficult with such shots as approach the player straight on, and other variations. While relatively minor leg and ankle injuries are common in tennis, racquetball and other similar sports, wrist and arm injuries are not at all unknown, particularly for the relatively unskilled player who does not exercise regularly the particular muscles, tendons and ligaments used in the play of the particular game.

The game of handball is even more restrictive, as the mitt or pad used on the hand provides only a single surface adjacent the palm of the hand, for striking the ball. Oftentimes, a player must turn or twist his/her wrist or arm to an excessive degree to position the palm properly for the return of a difficult shot.

While most such sports and games include relatively rigid rules regarding the configuration of the racquets or other implements used, it will be seen that the modification of such rules to allow the use of a modified racquet providing greater latitude for the player, would be of great assistance in improving the game of such players and in preventing many muscle, tendon and ligament pulls and strains which can occur with the twisting of the wrist and arm for the return of certain shots with a conventional racquet or handball mitt.

The need arises for a multifaceted racquet for use in volleying type games, providing additional racquet faces to assist a player in the striking or return of a game projectile without undue twisting of the arm or wrist of the player. The racquet must be relatively lightweight, and provide good control by means of a centrally located handle, enabling the racquet to be positioned readily and quickly without undue strain. The multiple racquet faces are preferably equally distributed about the handle, in order to provide for ease of use of the racquet.

DESCRIPTION OF THE PRIOR ART

U.S. Pat. No. 1,930,281 issued to R. Douglas Ogden on Oct. 10, 1933 discloses an Implement For Playing An Improved Game Of Skill. The implement comprises two generally opposed solid planar panels with a handle interposed therebetween. The device is relatively limited, providing no more striking surface than a standard racquet with its two sides for forehand or backhand use. The solid surfaces provide no resilience as a strung racquet surface does.

U.S. Pat. No. 3,416,798 issued to William C. Pennington on Dec. 17, 1968 discloses a Golf Club With Two Hitting Faces. The faces are not symmetrically distributed about the elongate shaft extending from the head, and the head is solid, unlike the open central area and handle therein of the present invention.

U.S. Pat. No. 4,368,890 issued to John W. Horstman on Jan. 18, 1983 discloses a Paddle Game Apparatus having a central handle between a paddle and a basket in a coplanar array on opposite sides of the handle. The paddle and basket configuration result in completely different resiliency characteristics for the two elements, and their coplanar arrangement limits the angular versatility of the device in comparison with the multidimensional nature of the present invention.

U.S. Pat. No. 4,512,583 issued to Laurent Leveque de Vilmorin on Apr. 23, 1985 discloses a Golf Club For Instruction Or Recreation having three striking surfaces on a single head. The club is essentially a variation on the two surfaced club of the Pennington patent discussed above.

U.S. Pat. No. 5,074,554 issued to Armando Ramon, Jr. on Dec. 24, 1991 discloses a Game Apparatus Utilizing A Striking Member Having Dual Hand Grips And Triple Paddles. The title is descriptive of the device, but further differences are seen between the device and the present invention, such as the solid, non-resilient paddles and the linear and coplanar paddle array. The coplanar paddle array is not seen to provide any advantage over a conventional paddle, other than providing for simultaneous positioning of the three paddles in various locations.

Canadian Patent No. 909,812 issued to Elmen Tremblay on Sep. 12, 1972 discloses a Punching Exerciser And Amusement Device comprising a single paddle with a handle attached across the non-striking surface. This results in only a single striking surface being provided, which severely limits the versatility of the device; it is more akin to a handball glove than to the various devices discussed above having multiple striking surfaces.

Finally, European Patent No. 427,522 to Marvin Glass & Associates Liquidating Trust and published on May 15, 1991 discloses a Game Apparatus For Hitting A Missile similar to the device of the Ramon, Jr. patent discussed above. The apparatus includes three spaced apart and coplanar striking surfaces with two spaced apart handles therebetween, but the central striking surface is smaller than the two distal paddles or surfaces.

None of the above noted patents, taken either singly or in combination, are seen to disclose the specific arrangement of concepts disclosed by the present invention.

SUMMARY OF THE INVENTION

By the present invention, an improved racquet or the like for use in volleying type games is disclosed.

Accordingly, one of the objects of the present invention is to provide an improved racquet which includes plural, non-coplanar and spaced apart racquet faces with a handle means extending therebetween.

Another of the objects of the present invention is to provide an improved racquet which plural faces are assembled in a three dimensional array about the handle means, with the surfaces thereby forming a polyhedral configuration.

Yet another of the objects of the present invention is to provide an improved racquet which plural faces are strung to provide resilient surfaces.

Still another of the objects of the present invention is to provide an improved racquet which plural faces each have a substantially circular periphery.

A further object of the present invention is to provide an improved racquet which includes five faces arranged in a generally cubical array, with one face of the cube open to provide access to the handle means disposed therein.

An additional object of the present invention is to provide an improved racquet having plural faces each of equal size and shape.

Another object of the present invention is to provide an improved racquet which handle means is located at the geometric center thereof, thereby reducing or eliminating non-symmetrical forces when a projectile is struck squarely.

Yet another object of the present invention is to provide an improved racquet which may be constructed from a variety of materials, such as wood, metal, synthetics and plastics, and/or synthetic fiber materials such as glass fiber and carbon fiber.

A final object of the present invention is to provide an improved racquet for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 1:
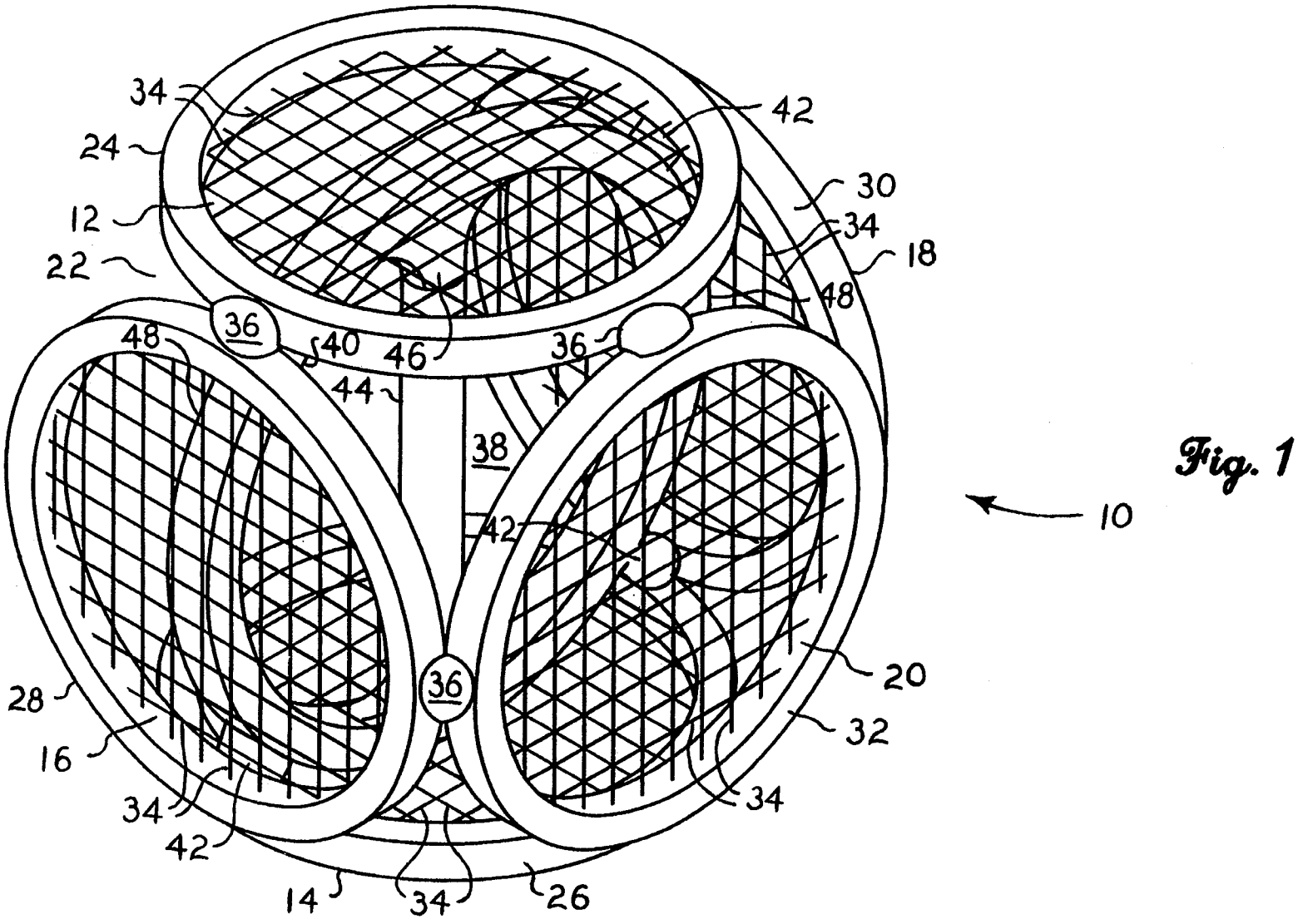
FIG. 1 is a front, right and top perspective view of the multifaceted racquet of the present invention, showing its general configuration and structure.

Referring now to the drawings, the present invention will be seen to relate to a multifaceted racquet 10 for use in the play of volleying sports and games, e.g., handball, racquetball, squash, etc. In the preferred embodiment, the racquet 10 includes plurality of projectile contact sides or faces comprising a first face 12, a second face 14 spaced apart from and opposite the first face 12, spaced apart and opposed third and fourth faces 16 and 18 extending between the first and second faces 12 and 14, and a fifth face 20 which extends between the first through fourth faces 12 through 18. In addition to the above five racquet faces 12 through 20, it will be seen that the above arrangement defines a sixth side 22 for the array; this sixth side 22 is open, to provide access to the interior of the assembly and the handle means therein, which handle means is discussed further below.

In the above configuration, the opposed first and second sides 12 and 14 are parallel to one another, as are the opposed third and fourth sides 16 and 18. The three side groups comprising the first and second sides 12 and 14, the third and fourth sides 16 and 18, and the fifth side 20 and open sixth side 22 form the sides of a generally cubical structure, with each of the sides 12 through 20 being of equal size. Such a configuration places each side or surface 12 through 20 at right angles to at least three other sides (not counting the open side 22), to provide essentially equal facility in returning forehand, backhand, overhead or direct volleys. However, it will be seen that such a six sided cubical configuration is not vital to the structure of the present invention, and that multifaceted racquets having more or fewer sides with different included angles therebetween may be constructed if desired, e. g., tetrahedral, dodecahedral, etc. three dimensional shapes.

Figure 2:
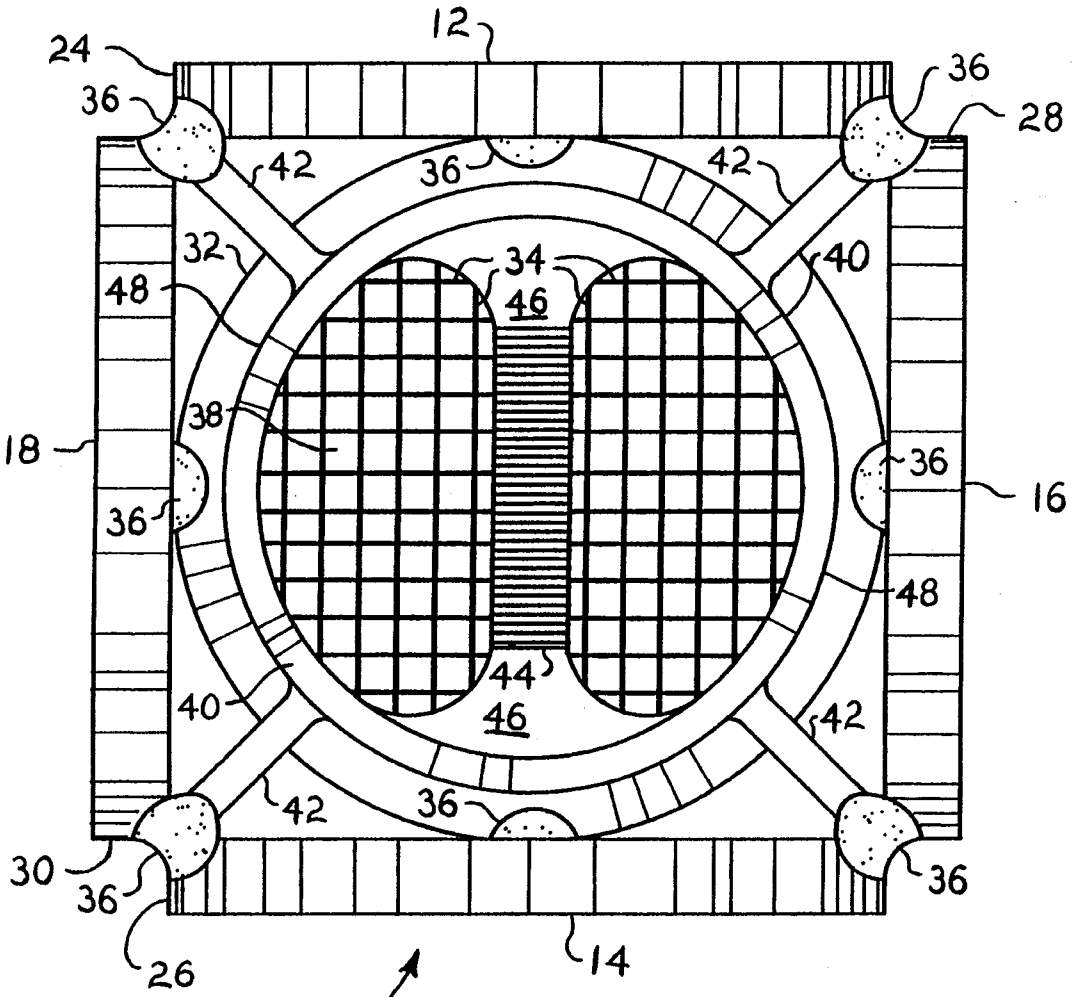
FIG. 2 is a rear elevation view of the racquet, providing a clearer disclosure of the interior and details of the handle means therein.

Each face 12 through 20 of the multifaceted racquet 10 respectively includes a periphery 24 through 32 having an open area therein, providing for a plurality of racquet strings 34 to be strung thereacross. Preferably, each of the faces or sides 12 through 20 of the multifaceted racquet 10 is substantially circular in shape, as shown in FIGS. 1 and 2. Such circular, or at least oval or elliptical, shapes provide relatively uniform stresses around the periphery of each face when tautly strung. However, it will be seen that the various faces of such a multifaceted racquet may be provided with other plane shapes, e.g., square, in the case of the embodiment of FIGS. 1 and 2, if desired. Such non-circular faces would be particularly appropriate in the case of a multifaceted racquet in which each of the surfaces were solid.

Each of the faces or sides are secured together at joints 36, which serve to join each of the faces at their adjacent peripheries. Thus, the periphery of the first face 12 is adjacent and joined to the third and fourth face peripheries 16 and 18, and the fourth face periphery 26 is joined to the third and fourth face peripheries opposite the junctures of the first face periphery 24 thereto. The fifth face periphery 32 is joined to the first, second, third, and fourth face peripheries 24 through 30. The above joint structure provides a rigid and solid structure for the multifaceted racquet 10 of the present invention.

FIG. 2 provides a clearer view of the handle means installed within the interior 38 of the multifaceted racquet 10. An open handle frame 40 is installed within the interior 38 of the racquet 10, and secured therein by a plurality of radially extending handle frame supports 42; preferably at least one support 42 extends to each of the coplanar peripheral face joints joining the first through fourth faces 12 through 18 together. An elongate handle 44 extends diametrically across the open center of the handle frame 40, and is secured thereto at handle attachments 46. Preferably the handle 44 is parallel to the second and third faces 16 and 18, but alternatively may be installed at any angle relative to the racquet faces 12 through 18 as desired.

It will be noted that the outer periphery 48 of the handle frame 40 has a maximum width or diameter which is somewhat less than the distance across the interior 38 (which is equal to the width of any of the first through fifth faces 12 through 20, in the embodiment of FIGS. 1 and 2). This provision allows the strings 34 of any of the faces to flex resiliently inward when striking a projectile, and not be limited by any underlying structure.

Accordingly, the multifaceted racquet of the present invention provides for ease of a return of a volley in such volleying type games as racquetball, handball, and squash and the like. The present racquet allows a player to return backhand, forehand, underhand, overhead, and direct volleys without resorting to undue twisting or turning of the arm or wrist, as at least one surface will always be within 45 degrees of the desired return angle, with the cubical array of faces of the embodiment of FIGS. 1 and 2; other embodiments having even more faces would result in even less need to twist or turn the arm and/or wrist. The centrally located handle means provided ensures (assuming a shot is struck squarely in the center of one of the racquet faces) that no asymmetrical forces will be transmitted to the player's hand, wrist and arm, unlike racquets having handles extending from a single surface. Thus, the multifaceted racquet of the present invention provides greater safety and assurance for a player using it, and thus provides added enjoyment of any volleying type game wherein the present multifaceted racquet is used.

It is to be understood that the present invention is not limited to the sole embodiment described above, but encompasses any and all embodiments within the scope of the following claims.

I claim:

1. A multifaceted racquet comprising:

a plurality of projectile contact faces disposed in a non-coplanar array in at least three intersecting planes and forming a substantially polyhedral exterior shape enclosing an interior, each of said contact faces including a periphery, wherein adjacent contact faces are attached at joints along said periphery;

handle means disposed centrally within said interior; and means for securing said handle means to at least one of said joints of said plurality of projectile contact faces;

said plurality of projectile contact faces includes a first surface, a second surface, a third surface, a fourth surface, and a fifth surface;

said first face disposed opposite said second face, and said third face disposed opposite said fourth face;

said third face and said fourth face joined to said first face and said second face at each said periphery thereof;

said fifth face joined to said first face, said second face, said third face and said fourth face at each said periphery thereof;

said handle means including a circular outer periphery having a diameter less than the diameter of said periphery of said fifth face, wherein said handle periphery is disposed substantially parallel to said, fifth face;

wherein said joints at the periphery of said first face, said second face, said third face and said fourth face include support means connected to said periphery of said handle means for supporting said handle means within said interior.

2. The multifaceted racquet of cllaim 1 wherein:

a plurality of string members are strung across said periphery of each said contact face.

3. The multifaceted racquet of claim 1 wherein:

said handle means comprises an elongate handle secured diametrically within a handle frame, with said handle frame being smaller than said polyhedral exterior shape of said multifaceted racquet and disposed entirely within said interior, and;

said handle frame is joined to said projectile contact faces to provide said handle means for said multifaceted racquet.

4. The multifaceted racquet of claim 1 wherein:

said handle means comprises a handle frame, an elongate handle secured diametrically within said handle frame, wherein said handle frame is smaller than said polyhedral exterior shape of said multifaceted racquet;

said handle frame is joined to said projectile contact faces at each said periphery to provide handle means for said multifaceted racquet.

5. The multifaceted racquet of claim 1 wherein:

said handle means is disposed substantially through the geometric center of said multifaceted racquet, whereby non-symmetrical forces are substantially reduced when a projectile is struck squarely by one of said projectile contact faces.

6. The multifaceted racquet of claim 1 wherein:

said first face and said second face are attached at substantially right angles to said third face and said fourth face, and said fifth face is attached at substantially right angles to said first face, said second face, said third face, and said fourth face, whereby;

each said face of said multifaceted racquet collectively define a substantially cube shaped polyhedron with the exception of a single open side, with said single open side providing access to said handle means within said multifaceted racquet.

7. The multifaceted racquet of claim 6 wherein:

said handle means includes an elongate handle disposed substantially parallel to said third face and said fourth face.

8. The multifaceted racquet of claim 1 wherein:

each of said projectile contact faces is substantially circular in planform.

9. The multifaceted racquet of claim 1 wherein:

each of said projectile contact faces is of equal size and shape.

10. The multifaceted racquet of claim 1 wherein:

said multifaceted racquet is formed of wood.

11. The multifaceted racquet of claim 1 wherein:

said multifaceted racquet is formed of metal.

12. The multifaceted racquet of claim 1 wherein: said multifaceted racquet is formed of a synthetic material.

13. The multifaceted racquet of claim 13 wherein: said synthetic material is plastic.

14. The multifaceted racquet of claim 1 wherein: said multifaceted racquet is formed of a synthetic fiber matrix.

15. The multifaceted racquet of claim 14 wherein: said synthetic fiber matrix comprises glass fiber.

16. The multifaceted racquet of claim 14 wherein: said synthetic fiber matrix comprises carbon fiber.

17. The multifaceted racquet of claim 1 wherein:

said handle means includes a circular outer periphery having a diameter less than the distance across said interior.

18. The multifaceted racquet of claim 7 wherein:

said elongate handle passes through the geometric center of said polyhedral exterior shape.

* * * * *